US006637629B2

(12) United States Patent
Ohtsuka et al.

(10) Patent No.: US 6,637,629 B2
(45) Date of Patent: Oct. 28, 2003

(54) IMMERSION NOZZLE

(75) Inventors: Hiroshi Ohtsuka, Kariya (JP); Etuhiro Hasebe, Kariya (JP); Kouji Enomoto, Kariya (JP)

(73) Assignee: Toshiba Ceramics Co., Ltd., Tokyo (JP)

( * ) Notice: Subject to any disclaimer, the term of this patent is extended or adjusted under 35 U.S.C. 154(b) by 0 days.

(21) Appl. No.: 10/142,943

(22) Filed: May 13, 2002

(65) Prior Publication Data

US 2002/0190443 A1 Dec. 19, 2002

Related U.S. Application Data

(63) Continuation-in-part of application No. 09/819,890, filed on Mar. 29, 2001, now abandoned.

(30) Foreign Application Priority Data

Apr. 18, 2000 (JP) ..... 2000-116125

(51) Int. Cl.[7] ..... B22D 35/00
(52) U.S. Cl. ..... 222/606; 501/99
(58) Field of Search ..... 222/603, 606, 222/607; 501/100, 99, 104

(56) References Cited

U.S. PATENT DOCUMENTS 4,989,762 A 2/1991 Ando et al.
5,171,495 A * 12/1992 Luhrsen et al. ..... 264/63

FOREIGN PATENT DOCUMENTS

| | | | |
|---|---|---|---|
| EP | 0 354 304 | A1 | 2/1990 |
| JP | 57-184562 | A | 11/1982 |
| JP | 59-130662 | A | 7/1984 |
| JP | 61-202754 | A | 9/1986 |
| JP | 3-268849 | A | 11/1991 |
| JP | 7-61855 | A | 3/1995 |
| JP | 2001-261155 | | 8/2001 |

OTHER PUBLICATIONS

Patent Abstracts of Japan, Publication No. 56–139260, Takeo Otani et al., "Nozzle for Casting," Oct. 30, 1981, Japanese Patent Office.
Patent Abstracts of Japan, Publication No. 10–296407, Nobuhiro Hasebe et al., "Nozzle for Continuous Casting," Nov. 11, 1998, Japanese Patent Office.
Patent Abstracts of Japan, Publication No. 10–314905, Osamu Nomura et al., "Continuous Casting Nozzle for Steel," Dec. 2, 1998, Japanese Patent Office.

* cited by examiner

*Primary Examiner*—Scott Kastler
(74) *Attorney, Agent, or Firm*—Foley & Lardner

(57) ABSTRACT

The invention presents an immersion nozzle having corrosion resistance to steel of high oxygen content or type of steel treated with calcium, and capable of preventing adheres and deposits of molten steel and oxide inclusions on the nozzle inner wall, in which at least a part of its portion contacting with molten steel is composed of a refractory material containing 50 wt. % or more of a principal component including one or more types of magnesia, alumina, spinel, zirconia, mullite, and silica, and also 0.3 to 15 wt. % of boron nitride, and an organic binder.

6 Claims, 1 Drawing Sheet

IMMERSION NOZZLE

This application is a continuation-in-part of parent U.S. application Ser. No. 09/819,890 filed Mar. 29, 2001, now abandoned, which claims priority to Japanese Application 2000-116125 filed Apr. 18, 2000. The contents of both U.S. application Ser. No. 09/819,890 and Japanese Application 2000-116125 are hereby incorporated by reference in their entirety.

BACKGROUND OF THE INVENTION

1. Field of the Invention

[The present invention relates to an immersion nozzle, and more particularly to an immersion nozzle for pouring molten steel in a tundish into a mold in continuous casting, or an immersion nozzle made of a refractory material having high corrosion resistance, and capable of suppressing adheres and deposits of matrix metal or nonmetallic inclusion on the nozzle inner wall when used for a long time.

2. Description of the Related Art

In continuous casting, immersion nozzles are used as long nozzle and air seal pipe used between the ladle and tundish, or nozzle for pouring molten steel in the tundish into the mold. These immersion nozzles are required to have such characteristics as spalling resistance, wear resistance and corrosion resistance to molten steel or slag depending on the environments of use.

To meet such requirements, hitherto, alumina-graphite material or alumina-silica-graphite material has been used as the refractory material for immersion nozzle.

In such alumina-silica-graphite refractory material, however, in casting of steel of high oxygen content or type of steel treated with calcium, alumina and silica are eroded by FeO and CaO, and cannot withstand use for a long time.

Accordingly, reducing the content of silica which is relatively low in corrosion resistance, an alumina-graphite refractory material is used, but the resistance of graphite to oxidation and corrosion is low, and sufficient durability is not obtained.

Besides, in the alumina-graphite or alumina-silica-graphite refractory material, the inclusion due to Al oxidation or slag in molten steel adheres and deposits on the inner wall of the immersion nozzle, and the nozzle is likely to be clogged.

If the immersion nozzle is clogged, it is impossible to control the flow rate of molten steel, and operation of continuous casting is difficult, and moreover as the adheres and deposits on the inner wall of immersion nozzle are separated during operation, the quality of product steel is lowered.

As means for preventing such clogging of immersion nozzle, a method of blowing inert gas into the immersion nozzle is proposed. According to this method, adheres and deposits of oxide inclusions such as alumina cluster on the nozzle inner wall can be prevented, but fine bubbles from the blowing gas are taken into the molten steel, and pinholes may be formed, or defects of steel may occur due to entrapping of inclusions. This problem is caused by fine bubbles taken into the molten steel, and it is hence very difficult to solve.

Among other means, from the viewpoint of material of immersion nozzle, as disclosed in Japanese Patent Application Laid-Open No. 56-139260, an immersion nozzle composed of a refractory material containing 5 to 80% of boron nitride has been proposed. More recently, as disclosed in JP-A No. 10-314905, immersion nozzles made of refractory material not containing carbon or lowered in carbon content are proposed in order to prevent adhesion of alumina.

The present inventors noticed the material of the immersion nozzle as possible means for solving the problem of nozzle clogging, and attempted to improve the existing material.

That is, in the immersion nozzle composed of a refractory material containing 5 to 80% of boron nitride proposed in JP-A No. 56-139260, since it is based on the use of graphite, it involved the technical problem of insufficient effect on corrosion resistance and prevention of clogging.

Or in the immersion nozzle made of refractory material free from carbon or lowered in carbon content, although there is an effect of prevention of adhesion sticking of alumina and other oxide inclusion on the nozzle inner wall, there is still a technical problem of insufficient prevention of adhesion of molten steel itself.

Thus, in the conventional technologies about the material proposed as means for preventing nozzle clogging, various problems existed, and the effect for preventing clogging was not sufficient.

The invention is devised to solve the problems of the prior arts, and it is hence an object thereof to present an immersion nozzle having corrosion resistance to steel of high oxygen content or type of steel treated with calcium, and capable of preventing adheres and deposits of molten steel and oxide inclusions on the nozzle inner wall.

SUMMARY OF THE INVENTION

In the immersion nozzle of the invention, at least a part of its portion contacting with molten steel is composed of a refractory material containing 50 wt. % or more of a principal component including one or more types of magnesia, alumina, spinel, zirconia, mullite, and silica, and also 0.3 to 15 wt. % of boron nitride, and an organic binder.

This refractory material is low in coefficient of expansion, and small in wettability to molten steel, and moreover since boron nitride excellent in wear resistance, spalling resistance, and lubricity is used, clogging of nozzle is prevented, and an immersion nozzle excellent in durability is presented.

In the immersion nozzle of the invention, further, a thin wall layer of 2 to 15 mm in thickness is formed by this refractory material.

The thin wall layer is preferred to be formed in the specified thickness, at least in the portion contacting with the molten steel, from the viewpoint of nozzle clogging preventive effect and structural peeling of refractory material.

DESCRIPTION OF THE PREFERRED EXAMPLES

Figure 1:
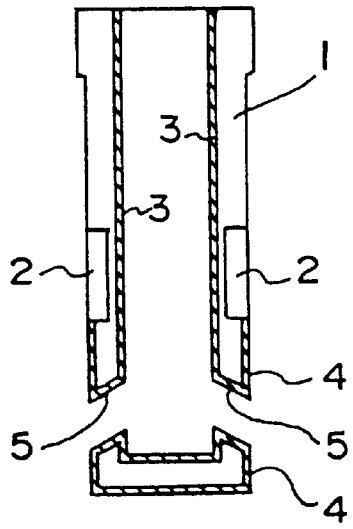
FIG. 1 is a sectional view showing an example of immersion nozzle for continuous casting according to the invention.

The invention is more specifically described below.

The refractory material used in the immersion nozzle of the invention contains 50 wt. % or more of a principal component including one or more types of magnesia, alumina, spinel, zirconia, mullite, and silica, and also 0.3 to 15 wt. % of boron nitride, and an organic binder.

Thus, by containing boron nitride in the refractory material, cracks and other breakages hardly take place, and the immersion nozzle can prevent adheres and deposits of molten steel and oxide inclusion on the nozzle inner wall. The boron nitride is low in coefficient of expansion, and is small in wettability to molten steel, and moreover it is excellent in wear resistance, spalling resistance, and lubricity.

If the content of boron nitride in the refractory material is less than 0.3 wt. %, sufficient lubricity of refractory material is not obtained. Or if the content of boron nitride in the refractory material exceeds 15 wt. %, the sinterability of the refractory material drops and the strength declines, while the cost is increased.

In the refractory material, one or more types of magnesia, alumina, spinel, zirconia, mullite, and silica is contained as principal component.

Herein, magnesia, spinel, zirconia, and mullite are high in coefficient of thermal expansion, and the refractory material may be crack or breakages during use of the nozzle. However, these oxide materials are high in melting point and high in hardness, and the corrosion resistance to FeO and CaO is excellent as compared with that of alumina or silica.

In these oxide materials, therefore, by blending a specified amount of boron nitride and organic binder, the coefficient of thermal expansion can be lowered, so that the nozzle hardly broken and excellent in corrosion resistance is obtained.

The principal component composed of one or more types of magnesia, alumina, spinel, zirconia, mullite, and silica is preferred to be contained by 50 wt. % or more in total.

If the total content of one or more types of magnesia, alumina, spinel, zirconia, mullite, and silica is less than 50 wt. %, sufficient corrosion resistance of refractory material is not obtained. Further, to prevent digestion of magnesia, it is preferred to contain silica, and the content of silica is preferably smaller than that of magnesia.

It is preferred that 15 to 30% of the whole content of alumina is composed of the alumina fine powder with particle size of 10 $\mu$m or less.

By the heat at the time of sintering or when receiving the steel, said alumina fine powder reacts with magnesia fine powder component with particle size of 30 mm or less within the material and form a crystal of spinel ($Al_2MgO_4$) which is made of ratio 1:1 reactant of $Al_2O_3$ and MgO, between particles of alumina.

Said micro spinel crystal formed between the particles of alumina expands when it is formed and come into close contact with the particles of alumina to bond the particles firmly that the strength and the corrosion resistance are added to the refractory material.

It is preferred that magnesia is composed of the magnesia fine powder with particle size of 30 $\mu$m or less.

By the heat at the time of sintering (generally 900 to 1400° C.) or from the cast when the machine is in use, the alumina fine powder of less than 10 $\mu$m reacts with magnesia fine powder component and form a crystal of spinel between the particles of alumina.

Said spinel crystal expands when it is formed and come into close contact with the particles of alumina to bond the particles of alumina firmly the spinel binding.

The spinel binding is much stronger than for example the binding with graphite or the like, and therefore the stength of the refractory material trebles and the corrosion resistance is also improved.

The refractory material used in the immersion nozzle of the invention does not contain graphite unlike the conventional nozzle made of alumina-graphite material or the like. Accordingly, oxidizing gas is not generated by the reaction between the graphite and other ingredients in the refractory material during use, and the aluminum in the molten steel is not oxidized, and formation of alumina can be prevented. Hence, product steel of high quality is obtained.

An organic binder is also contained in the refractory material. The organic binder is intended to lower the coefficient of expansion of the refractory material, and prevent crack or breakage during use of the nozzle. The organic binder is not particularly limited, and phenol resin and other ordinary binder may be used.

The refractory material is preferred to be formed in a thin wall layer of 2 to 15 mm in thickness in the portion contacting with the molten steel of the immersion nozzle.

If the thickness of the thin wall layer is less than 2 mm, the corrosion resistance is not sufficient, and the nozzle clogging preventive effect is not enough. On the other hand, if the thickness of the thin wall layer exceeds 15 mm, the refractory material may cause structural peeling.

The thin wall layer is not required to be formed on all of the portion contacting with the molten steel, but may be formed at least in the nozzle inner wall in order to prevent clogging of nozzle.

Figure 2:
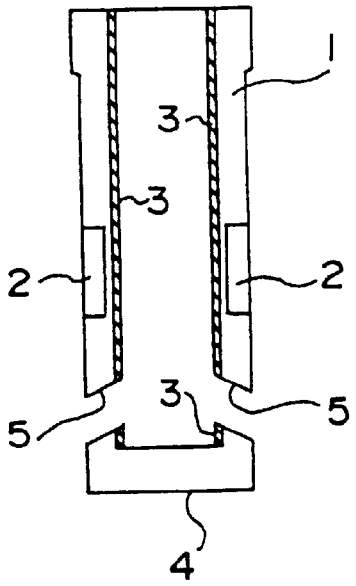
FIG. 2 is a sectional view showing an example of immersion nozzle for continuous casting according to the invention.

The structure of the immersion nozzle of the invention is not particularly limited, and examples of structure of refractory in the immersion nozzle may include structures shown in FIG. 1 and FIG. 2.

That is, as shown in FIG. 1, a nozzle main body 1 of the immersion nozzle is composed of an alumina-graphite refractory material generally used in the immersion nozzle, and a powder line portion 2 is composed of zirconia-graphite refractory material. In a nozzle inner wall 3, a nozzle outer wall 4, and a nozzle inner hole wall 5 of the immersion nozzle, a thin wall layer of refractory material containing boron nitride of the invention is formed.

In FIG. 2, a thin wall layer of refractory material containing boron nitride of the invention is formed only in the nozzle inner wall 3.

The manufacturing method of the immersion nozzle of the invention is not particularly limited, but the following example may be presented.

First, materials of the refractory material are kneaded in a mixer. The obtained mixture is charged into a molding pattern, and is molded by CIP molding, die press or the like. The obtained molded piece is dried, and burned in non-oxidizing atmosphere. After burning, as required, it is processed into final shape, and the intended immersion nozzle is obtained.

The refractory material used in the immersion nozzle of the invention contains boron nitride, and hence the mixture of the materials is excellent in lubricity, and it is easier to work in the molding process as compared with the refractory materials free from carbon.

It is therefore possible to form integrally in the inner wall of the nozzle main body made of alumina-graphite refractory material. As a result, structurally, the spalling resistance is enhanced.

EXAMPLES

The invention is further explained by referring to preferred examples, but it must be noted that the invention is not limited to the examples alone.

Example 1

In a nozzle main body composed of 36 wt. % of alumina, 30 wt. % of graphite, 25 wt. % of organic binder, and 9 wt. % of silicon carbide, a refractory material in the blending composition in samples No. 1 to 4 of the invention shown in Table 1 was formed in the inner wall of the immersion nozzle as 5 mm thick thin wall layer, and an immersion nozzle as shown in FIG. 2 was manufactured.

Using this immersion nozzle, casting was tested in an actual furnace. A type of steel containing 0.03 wt. % of Al was used. As the continuous casting machine, a two-strand type machine was used, and installing the immersion nozzle in No. 1 strand, 5ch (casting time about 170 minutes) casting test was conducted 5 times.

After the test, in the straight shell portion of the nozzle, the adhere thickness was measured at three sections, and the average was determined. The average of five tests is shown as deposit thickness in Table 1.

Comparative Example 1

An immersion nozzle in the blending composition of comparative sample No. 1 shown in Table 1, that is, 36 wt. % of alumina, 30 wt. % of graphite, 25 wt. % of organic binder, and 9 wt. % of silicon carbide, was manufactured without forming thin wall layer, and it was installed in No. 2 strand of the continuous casting machine, and casting was tested.

The deposit thickness measured same as in example 1 is shown in Table 1.

Example 2

In a nozzle main body composed of 36 wt. % of alumina, 30 wt. % of graphite, 25 wt. % of organic binder, and 9 wt. % of silicon carbide, a refractory material in the blending composition in samples No. 1 to 5 of the invention shown in Table 2 was formed in the inner wall of the immersion nozzle as 5 mm thick thin wall layer, and an immersion nozzle as shown in FIG. 2 was manufactured.

Using this immersion nozzle, casting was tested in an actual furnace. A type of high oxygen steel (oxygen concentration: 200 ppm) was used. As the continuous casting machine, a two-strand type machine was used, and installing the immersion nozzle in No. 1 strand, 1ch (casting time about 60 minutes) casting test was conducted 3 times.

After the test, the maximum melt loss thickness of the inner wall was measured in the section of the straight shell portion of the nozzle. Results are shown in Table 2.

Comparative Example 2

An immersion nozzle in the blending composition of comparative samples No. 1 to 5 shown in Table 2 was manufactured without forming thin wall layer.

This immersion nozzle was installed in No. 2 strand of the continuous casting machine, and casting was tested in the same condition as in example 2.

After the test, the maximum melt loss thickness of the inner wall was measured in the section of the straight shell portion of the nozzle. Results are shown in Table 2.

TABLE 1

| | | Blending composition (wt. %) | | | | | | | | | Deposit thickness |
|---|---|---|---|---|---|---|---|---|---|---|---|
| | | Boron nitride | Magnesia | Alumina | Spinel | Zirconia | Silica | Organic binder | Graphite | Silicon carbide | (mm) |
| Sample No. of example 1 | 1 | 1 | 4 | 84 | — | — | 1 | 10 | — | — | 1.0 |
| | 2 | 5 | — | — | 85 | — | — | 10 | — | — | 0.8 |
| | 3 | 10 | — | — | — | 80 | — | 10 | — | — | 0.5 |
| | 4 | 10 | 39 | — | 40 | — | 1 | 10 | — | — | 0.9 |
| Sample No. of comparative example 1 | 1 | — | — | 36 | — | — | — | 25 | 30 | 9 | 13.7 |

As shown in Table 1, the deposit thickness of sample No. 1 to 4 of the invention was 1.0 mm or less, being less than 1/10 of sample No. 1 of the comparative example, and the deposits and adheres decreasing effect was noted.

TABLE 2

| | | Blending composition (wt. %) | | | | | | | | | Max. melt loss |
|---|---|---|---|---|---|---|---|---|---|---|---|
| | | Boron nitride | Magnesia | Alumina | Spinel | Zirconia | Silica | Organic binder | Graphite | Silicon carbide | thickness (mm) |
| Sample No. of example 2 | 1 | 1 | 4 | 84 | — | — | 1 | 10 | — | — | 0.5 |
| | 2 | 5 | — | — | 85 | — | — | 10 | — | — | 0.2 |
| | 3 | 10 | — | — | — | 80 | — | 10 | — | — | 0.1 |
| | 4 | 10 | 39 | — | 40 | — | 1 | 10 | — | — | 0.2 |
| | 5 | 10 | 4 | 75 | — | — | 1 | 10 | — | — | 0.6 |
| Sample No. of comparative example 2 | 1 | — | — | 36 | — | — | — | 25 | 30 | 9 | 23 |
| | 2 | 10 | 4 | 45 | — | — | 1 | 10 | 30 | — | 22 |
| | 3 | 10 | 4 | 65 | — | — | 1 | 10 | 10 | — | 20 |
| | 4 | 10 | 4 | 70 | — | — | 1 | 10 | 5 | — | 13 |
| | 5 | 10 | 4 | 74 | — | — | 1 | 10 | 1 | — | 7 |

As shown in Table 2, in continuous casting of high oxygen steel, the maximum melt loss thickness of the inner wall of the immersion nozzle was 0.6 mm or less in samples No. 1 to 5 of the example, being less than 1/10 of samples No. 1 to 5 of the comparative example, and the corrosion resistance to high oxygen steel was improved.

In particular, in comparative example samples No. 1 to 4 containing graphite by 5 wt. % or more, the maximum melt loss thickness was more than 20 times that of the example samples, and it was confirmed that the corrosion resistance is lower in the refractory containing graphite.

Therefore, samples of the example not containing graphite is recognized to be higher in corrosion resistance to high oxygen steel as compared with the comparative samples of the conventional parts.

Example 3

In a nozzle main body composed of 36 wt. % of alumina, 30 wt. % of graphite, 25 wt. % of organic binder, and 9 wt. % of silicon carbide, a refractory material in the blending composition in samples No. 1 to 5 of the invention shown in Table 2 was formed in the inner wall of the immersion nozzle as 5 mm thick thin wall layer, and an immersion nozzle as shown in FIG. 2 was manufactured.

Using this immersion nozzle, casting was tested in the same condition as in example 2.

After the test, the nozzle porosity was measured in accordance with JIS R 2205 (Measuring method for apparent porosity, water absorption specific gravity of refractory bricks). Moreover, the bending strength was measured in accordance with JIS R 2213 (Testing method for modulus of rupture of refractory bricks). Results of porosity and bending strength are shown in Table 3.

Comparative Example 3

In a nozzle main body composed of 36 wt. % of alumina, 30 wt. % of graphite, 25 wt. % of organic binder, and 9 wt. % of silicon carbide, a refractory material in the blending composition in comparative samples No. 6 and 7 shown in Table 3 was formed in the inner wall of the immersion nozzle as 5 mm thick thin wall layer, and an immersion nozzle as shown in FIG. 2 was manufactured.

In this immersion nozzle, the porosity and bending strength were measured same as in example 3. Results of porosity and bending strength are shown in Table 3.

As a result, the nozzle bending strength was lower in comparative samples No. 6 and 7, being less than 1/5 of sample No. 5 of the example.

Therefore, as the content of boron nitride increases, the porosity increases and the nozzle bending strength is lowered, and when exceeding 15 wt. %, it is recognized that sufficient strength for nozzle is not obtained.

As described herein, by using the immersion nozzle of the invention, the corrosion resistance is enhanced against the steel of high oxygen content or type of steel treated with calcium.

Moreover, adheres and deposits of molten steel and oxide inclusions on the nozzle inner wall can be prevented, and clogging of nozzle is prevented, so that the nozzle can be used continuously for a long period.

Therefore, by using the immersion nozzle of the invention, labor and time required in maintenance of nozzle in the casting process can be saved, and steel of high quality can be manufactured also in high oxygen steel or the like.

What is claimed is:

1. An immersion nozzle comprising at least one surface for contacting molten metal wherein at least a portion of said surface consists essentially of a refractory material and wherein said refractory material consists essentially of an organic binder, 80 to 90 weight % of one or more of magnesia, alumina, spinel, mullite and silica, and also 0.3 to 15 weight % of boron nitride.

2. An immersion nozzle according to claim 1 comprising a layer of said refractory material having thickness of 2 to 15 mm.

3. An immersion nozzle according to claim 1, wherein said refractory material consists essentially of 10 weight % organic binder, 4 weight % magnesia, 84 weight % alumina, 1 weight % silica and 1 weight % boron nitride.

4. An immersion nozzle according to claim 1, wherein said refractory material consists essentially of 10 weight % organic binder, 85 weight % spinel and 5 weight % boron nitride.

5. An immersion nozzle according to claim 1, wherein said refractory material consists essentially of 10 weight % organic binder, 39 weight % magnesia, 40 weight % spinel, 1 weight % of silica and 10 weight % boron nitride.

6. An immersion nozzle according to claim 1, wherein said refractory material consists essentially of 10 weight % organic binder, 4 weight % magnesia, 75 weight & of alumina, 1 weight % of silica and 10 weight % boron nitride.

TABLE 3

| | | Blending composition (wt. %) | | | | | | | | | | |
|---|---|---|---|---|---|---|---|---|---|---|---|---|
| | | Boron nitride | Magnesia | Alumina | Spinel | Zirconia | Silica | Organic binder | Graphite | Silicon carbide | Porosity (#) | Bending strength (MPa) |
| Sample No. of example 3 | 5 | 10 | 4 | 75 | — | — | 1 | 10 | — | — | 18.7 | 15 |
| Sample No. of comparative example 3 | 6 | 20 | 4 | 65 | — | — | 1 | 10 | — | — | 24.6 | 2.6 |
| | 7 | 30 | 4 | 55 | — | — | 1 | 10 | — | — | 36.7 | 1.4 |

As shown in Table 3, the porosity of sample No. 5 of the invention was 18.7%, but it was over 20% in comparative samples No. 6 and 7 containing boron nitride by 20 wt. % or more.

* * * * *